United States Patent [19]

Cukierski

[11] 4,406,318

[45] Sep. 27, 1983

[54] DRAPERY ASSEMBLY INCLUDING INSULATED DRAPERY LINER

[75] Inventor: Gwendolyn Cukierski, Ithaca, N.Y.

[73] Assignee: Cornell Research Foundation, Inc., Ithaca, N.Y.

[21] Appl. No.: 396,291

[22] Filed: Jul. 8, 1982

[51] Int. Cl.[3] ..... A47H 1/00

[52] U.S. Cl. ..... 160/126; 160/330

[58] Field of Search ..... 160/90, 92, 102, 124, 160/126, 330, 341, 344

[56] References Cited

U.S. PATENT DOCUMENTS

| | | | |
|---|---|---|---|
| 1,662,049 | 3/1928 | Abel | 160/92 |
| 2,495,636 | 1/1950 | Hoeltzel et al. . | |
| 2,569,290 | 9/1951 | Collestor | 160/330 |
| 2,748,851 | 6/1956 | Bussard . | |
| 2,755,520 | 7/1956 | Pesonen | 160/90 |
| 2,782,846 | 2/1957 | Bussard . | |
| 3,001,578 | 9/1961 | Ratliff . | |
| 3,372,729 | 3/1968 | Lindenmayer . | |
| 3,374,142 | 3/1968 | Kreckl . | |
| 3,513,900 | 5/1970 | Ronfola | 160/126 |
| 3,590,900 | 7/1971 | Salzmann | 160/126 |
| 3,811,996 | 5/1974 | Polk . | |
| 4,034,528 | 7/1977 | Sanders et al. . | |
| 4,039,019 | 8/1977 | Hopper . | |
| 4,079,771 | 3/1978 | Theiss | 160/102 |
| 4,141,611 | 2/1979 | De Leon . | |
| 4,188,991 | 2/1980 | Boyle . | |

*Primary Examiner*—Peter M. Caun

*Attorney, Agent, or Firm*—Lois P. Besanko

[57] ABSTRACT

A drapery assembly is disclosed for covering a framed wall opening, the assembly including drapery panels hung on a horizontal traverse rod, the rod having a pair of master slides and means for displacing the master slides between open and closed positions. A pair of insulating liner panels are positioned behind the drapery, the remote side edges of the liner panels being connected with the side portions of the opening frame, and the adjacent side edges of the liner panels being connected with a pair of vertically arranged center support members adapted for sliding movement longitudinally of a horizontal track member secured to the upper horizontal portion of the opening frame. Pivotally arranged brackets connect the center support members with the master slides of the traverse rod whereby movement of the master slides to effect opening and closing of the drapery panels effects simultaneous opening and closing of the liner panels.

6 Claims, 6 Drawing Figures

DRAPERY ASSEMBLY INCLUDING INSULATED DRAPERY LINER

The Government has rights in this invention pursuant to Grant No. FG-42-794205023 awarded by the U.S. Department of Energy.

BACKGROUND OF THE INVENTION

Despite the poor thermal performance of draperies hung on traverse rods they are the most popular window treatment, accounting for over 60% of all sales. The yearly expenditure for draperies approaches two billion dollars. Fabrics draped at windows have a long historical precedent and are popular because of the wide variety in appearance and price. However, the thermal performance of a drapery hung on a traverse rod is poor. Studies have shown the increased effectiveness over a single glazed double hung window to be a low 10%. This is primarily due to the rod design which positions the drapery fabric at an excessive distance from the window, leaving the top and bottom edges unsealed. Convective heat flow if exaggerated and causes what is known as the 'tunnel' effect where heated air is continually drawn past the window surface and cooled. In typical residential construction the heat source is located under the window, aggravating this problem. In the worst instance the drapery fabric is hung to the floor, often completely covering the heat source and trapping the heated air.

Previous attempts have been made to correct this heat loss by providing an insulating liner in conjunction with the drapery or by forming the draperies themselves from an insulatingtype material. The Lindenmayer U.S. Pat. No. 3,372,729 discloses draperies having insulation properties designed to be hung on a conventional rod at some distance from a window. The Ratliff U.S. Pat. No. 3,001,578 discloses a conventional pinch pleat drapery which includes magnetic means for sealing the draperies together at the bottom center edges. The patents to Hopper U.S. Pat. No. 4,039,019 and Boyle U.S. Pat. No. 4,188,991 disclose draperies or drapery liners including a reflective window-facing layer. However, none of these references, nor any other patents or references known to this inventor, has solved the problem of the heat loss caused by the unsealed drapery or liner positioned several inches from the window or door.

OBJECTS OF THE INVENTION

Accordingly, it is a primary object of the instant invention to provide a drapery assembly for a window or door including a thick fibrous multi-layered insulating drapery liner which is tightly sealed around its perimeter to the window or door frame and yet opens and closes with the drapery.

Another object of the invention is the provision of an insulating liner which is adaptable to both new and existing drapery installations, and is easy to install and operate.

A still further object of the invention is a drapery assembly including an insulating liner which maintains the appearance of draped fabric and which accommodates both floor and sill length draperies.

SUMMARY OF THE INVENTION

The most distinguishing feature of the instant invention is the placement of the insulating liner behind the pinch-pleated drapery where it is sealed directly over the window and yet is connected to a standard traverse drapery rod so that the liner opens and closes simultaneously with the drapery and is never visible. This is accomplished by the installation of a ceiling-type track member at the top of the window in combination with a unique center support apparatus adapted for sliding movement longitudinally of the track. A pair of insulating liner panels are secured to the window frame sides and to the center support members and extend in sealing relationship to the top and bottom of the window frame. Brackets connect the center support members with the master slides of the traverse rod so that as the drapery panels are drawn open, the liner panels are also drawn open (or closed) behind the draperies.

DESCRIPTION OF THE PREFERRED EMBODIMENT

Figure 1:
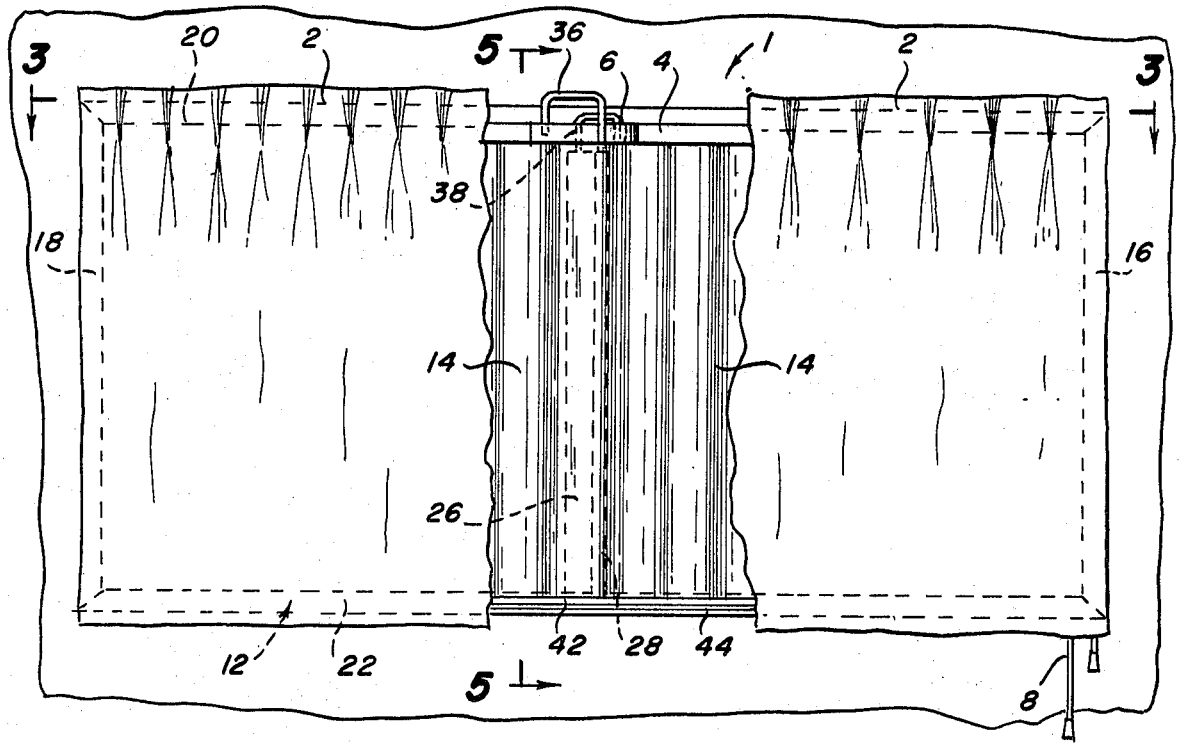
FIG. 1 is a front elevational view of the assembly of the instant invention with drapery and liner panels closed and drapery panels partially broken away.
Figure 2:
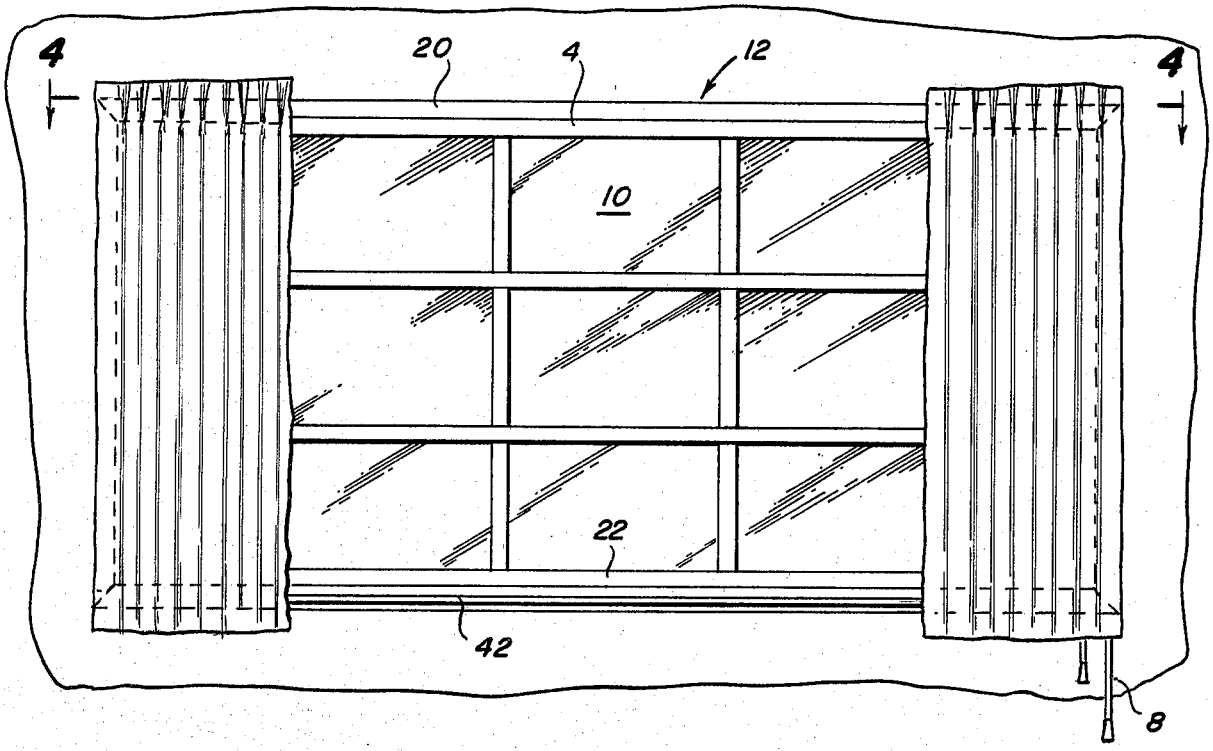
FIG. 2 is a front elevational view with drapery and liner panels open.

As shown in FIG. 1, the drapery assembly of the instant invention, generally indicated as 1, includes a pair of drapery panels 2 conventionally hung on a traverse rod 4, such as the rod sold by the Kirsch Co. of Sturgis, Michigan, under the number 3123. The rod includes a pair of master slides 6, 7 and means, in the form of pullcords 8, for displacing the master slides between adjacent and separated positions relative to each other in order to open and close the drapes over a wall opening 10, such as a door or a window, having a frame 12. The assembly further includes an insulated drapery liner in the form of a pair of coplanar liner panels 14 which open and close simultaneously with drapery panels 2. FIG. 2 illustrates the drapery and liner assembly in its opened position.

Figure 3:
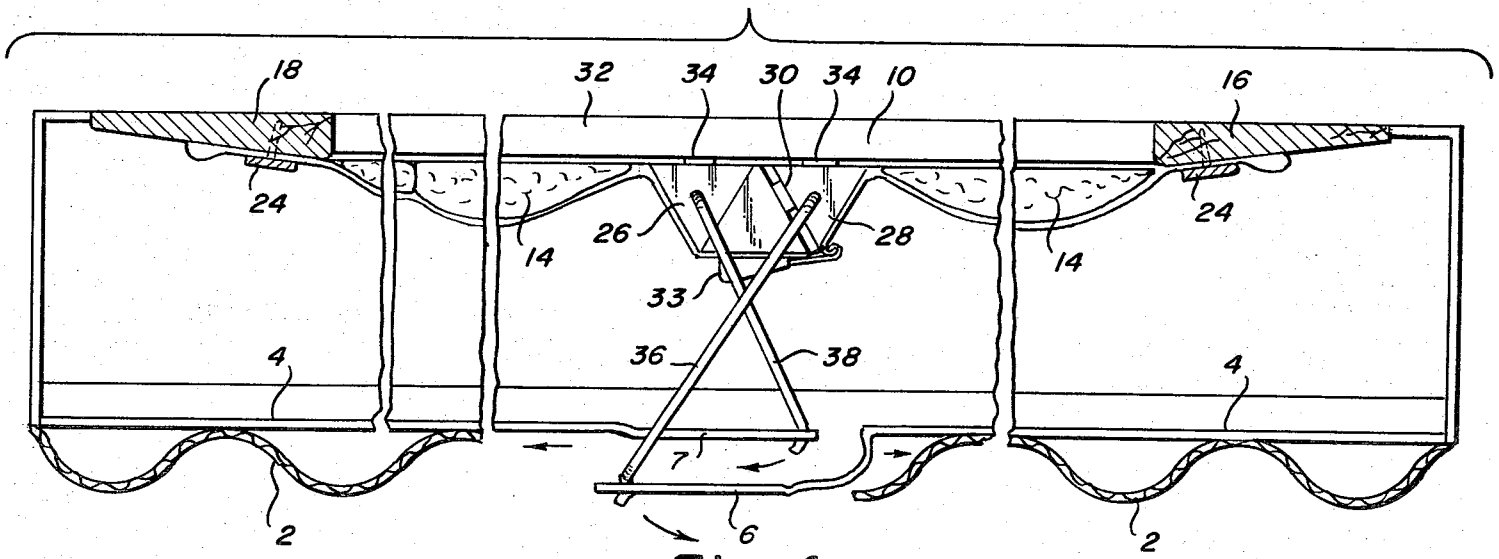
FIG. 3 is a longitudinal section taken on lines 3—3 of FIG. 2.

Referring now to FIG. 3, it can be seen that liner panels 14,14 are secured directly over window 10 considerably behind traverse rod 4 and any draperies hung thereon. The remote side edges of each liner panel 14 are connected with the window casing molding on side frame portions 16, 18 by means such as wood nailer strips 24. The nailer strip may be removed when it is desired to remove the liner panels such as for cleaning. As shown, the liner panels extend behind the side frame portions 16, 18. Excess liner fabric can be trimmed after the nailer strips 24 are in place.

In accordance with the innovative concepts of the present invention, a pair of center support members 26, 28 are provided to which are connected the inner, adjacent side edges of liner panels 14. Center support members 26, 28 provide a two-part, continuous, rigid, interlocking vertical support for joining and sealing liner panels 14 together after they have been drawn over opening 10. Center support members 26, 28 may be made of wood, plastic or metal, and are preferably formed as a series of triangles for strength and rigidity. As seen in FIG. 3, support member 26 may be in the form of two triangles secured together along the base lines of each to form a unitary trapezoidal piece, while support member 28 may comprise a single triangular piece. The edges of liner panels 14 are wrapped around center support members 26, 28 and a continuous length of V-strip weatherstripping 30 may be added to provide additional sealing when the support members and liner panels have been drawn together. Releasable locking means 33, such as a turnbuckle, are provided to pull center closure supports 26, 28 tightly together. Preferably, two turnbuckles are provided for a small window covering, located along the vertical closure at convenient locations for user access. Three or more turnbuckle-type locking means are needed for larger openings such as sliding glass doors.

Figure 5:
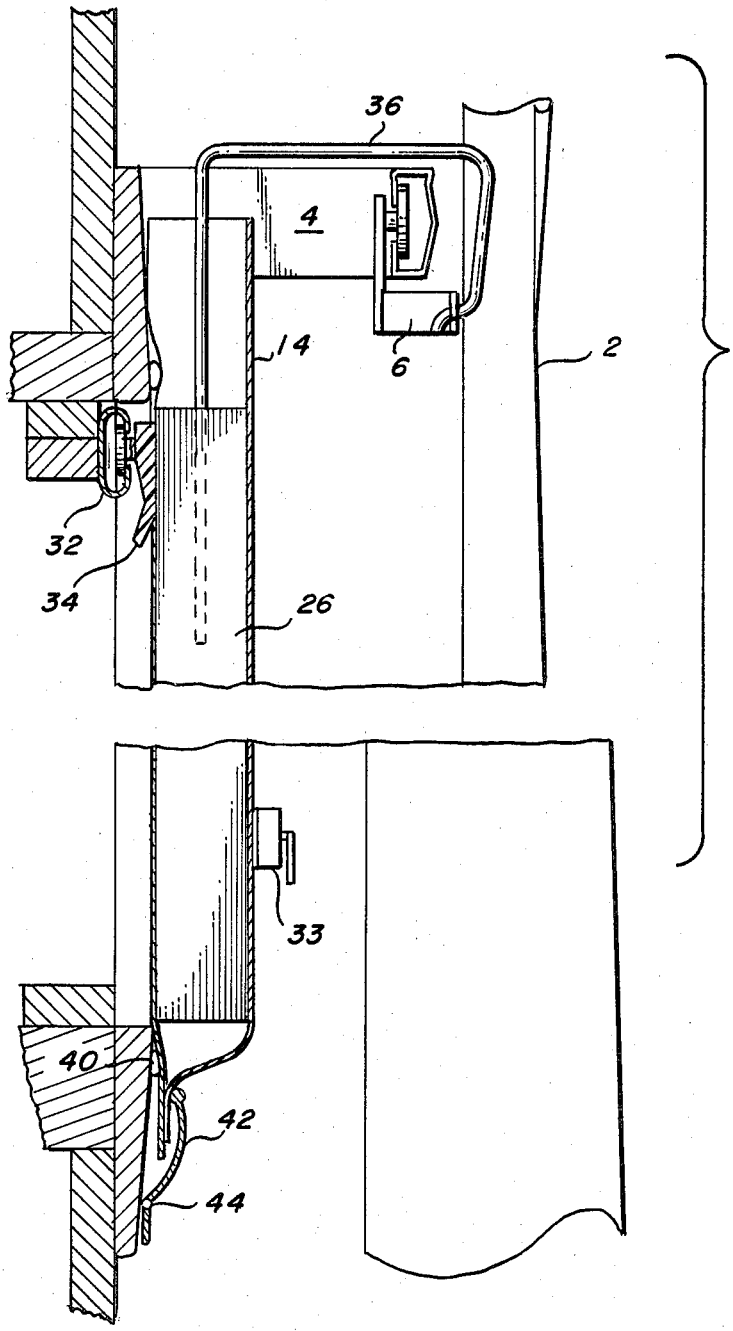
FIG. 5 is a vertical section taken on lines 5—5 of FIG. 1.

As shown in FIG. 5, closure closure support members 26, 28 are sized to fit within the vertical confines of frame 12; i.e., between frame top member 20 and frame bottom member 22. The top and bottom edges of liner panels 14, however, extend beyond the top and bottom of center support members 26, 28 and over frame members 20, 22, as will be more fully explained below.

Still referring to FIG. 5, a C-shaped channel or track member 32 is secured along the upper horizontal portion 20 of the opening frame, and extends the full length of the frame member. At the top of each center support member 26, 28, on the side thereof which faces the openings 10, a plastic slide 34 is secured, by means such as a screw. Channel or track member 32 and slide 34 may be standard items sold by Kirsch Co., such as metal ceiling track #9095 and lubrislide #3909. Slides 34 are inserted in track 32 so that the vertically arranged center support members 26, 28 are thus connected at their upper ends for sliding movement longitudinally of track member 32, and liner panels 14 connected with the support members may thus be opened or closed over opening 10.

Figure 4:
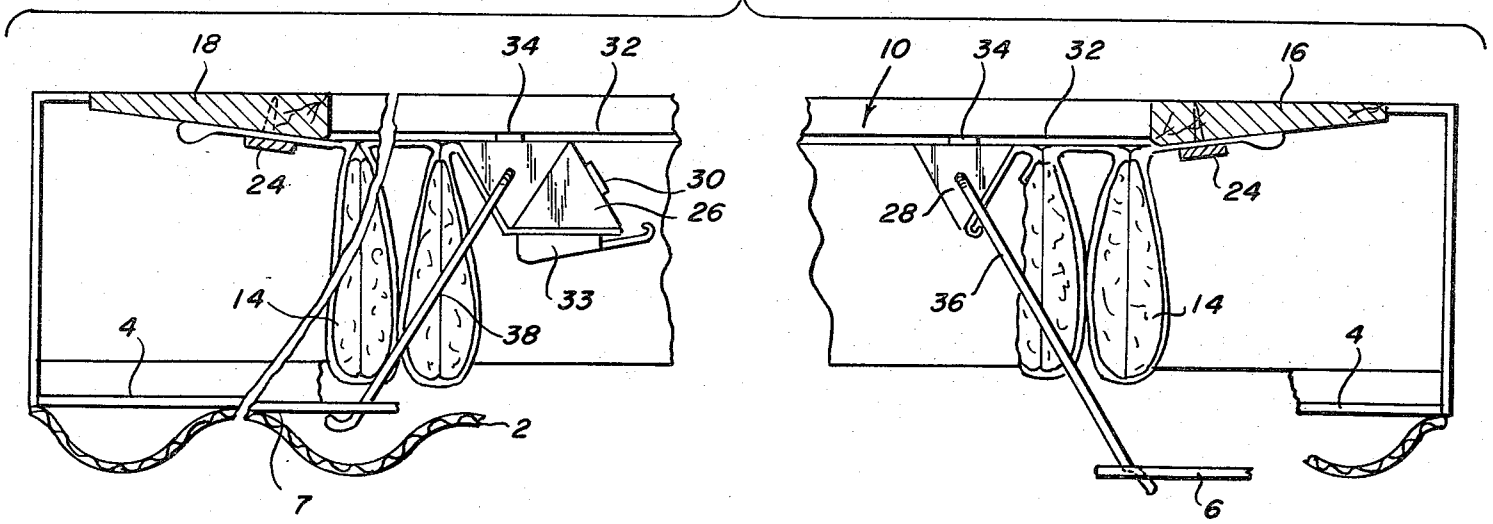
FIG. 4 is a longitudinal section taken on lines 4—4 of FIG. 2.

To enable the liner panels 14 to be opened and closed simultaneously with drapery panels 2, a pair of L-shaped bracket members 36, 38 are provided to connect center support members 26, 28 with master slides 6 and 7. As shown in FIGS. 3 and 5, one end of each bracket member 36, 38 is pivotally arranged at the top of each center support member 26, 28 by inserting a portion of the bracket leg in a hole provided in the top of the support member 20 that the bracket leg pivots freely within the hole. The remaining portion of each bracket leg extends above each center support member, respectively, and at least above the top of the liner panels 14. The horizontal leg of each bracket member 36, 38 extends outward to meet the master slides 6, 7 of the traverse rod, and is secured thereto. As is clearly shown in FIG. 3, the horizontal leg of the bracket 36 is somewhat longer than that of bracket 38 so that it reaches outermost master slide 6. FIG. 5 illustrates bracket members 36, 38 and master slides 26, 28 in their closed or drawn positions, with the bracket members pivoted in the center support members, and the horizontal legs angled across each other to meet the respective master slides. Clearly, when the master slides 6 and 7 are activated by pull cord 8 to open drapery panels 2, bracket member 36 will be pivoted to follow master slide 6, thereby causing center support member 28 to move along track 32 toward the end of the track and opening liner panel 2, while bracket members 38 and master slide 7 are caused to open the other liner panel 2. FIG. 4 illustrates the position of brackets 26, 28 and master slides 6, 7 in the open position adjacent the sides of opening 10.

Figure 6:
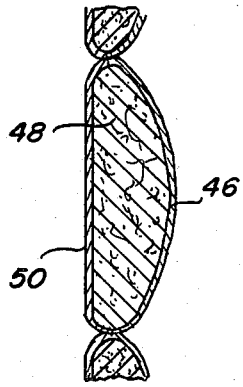
FIG. 6 is an enlarged sectional view of the liner panel.

The construction of the insulating liner panels 2, 2 is illustrated in FIG. 6. The panels are formed of a thick fibrous multi-layered material which is critical for optimum, thermal performance. At least three layers should be used—a room-facing non-permeable layer 46, a layer of material having insulating properties 48, and a window-facing layer of radiation-reflecting material 50. In the preferred construction, the insulating layer is formed of a material called Thinsulate made by Minnesota Mining and Manufacturing Co., of St. Paul, Minnesota. A layer of Foylon made by Duracote Corporation of Ravenna, Ohio, faces the window glass and a final layer of a non-permeable vinyl is used to provide the necessary vapor barrier on the warm or room side of the window treatment. The layers are quilted in vertical parallel rows about every three inches. The quilting may be achieved by rows of stitching, but preferably the layers are heat sealed or ultrasonically bonded to avoid stitch holes where air might penetrate. When the material is quilted, it is preferred that the Foylon or window-facing layer be pulled tight, while the vinyl fabric remains loose, thus permitting the insulating layer to remain lofty when the liner panels are drawn tightly over the window to effect a seal. When the panels are opened, they fold along the lines of quilting, as shown in FIG. 4.

As stated above, the liner panels are permanently sealed along their side edges to the window frame, and the center support members complete the horizontal seal at the center of the window or other opening. The top and bottom seals are achieved as shown in FIG. 5. The fabric of the liner panels 2 extends above and below center support members 26, 28 and at least two inches over top and bottom frame members 20 and 22, respectively. A section of weatherstripping 40 is secured along the horizontal length of each frame member 20, 22 near the window edge thereof, the weatherstripping providing means between the stretched liner panels for effecting a touching seal between the stretched liner panels 2 and frame portions 20, 22. In addition, a bottom closure means may be provided for further sealing the bottom edges of the panels 2 to the frame portion 22. This closure means may take the form illustrated in FIG. 5 where a flange 42 is biased by spring 44 against the bottom edges of the panel member 14. Of course, the flange may be pulled down to permit the liner panels to be pulled open. In the alternative, the bottom seal may be similar to that used at the top of the panels. A second horizontal track member may be secured at the bottom of opening 10 adjacent frame member 22, and a slide may be arranged at the lower end of each center support member. For a wide window, additional slides may be secured at selected points along the lower portion of the liner panels.

As has been clearly pointed out above, the drapery assembly of the instant invention includes an insulating drapery liner which is attached to the window frame, yet opens and closes with the conventional drapery. Daily operation involves only pulling the cord of the drapery traverse rod and closing the locking means on the center support members. Proper daily operation is essential to optimum thermal performance. In laboratory testing the effective R value of the liner of the instant invention is 3.80, while the calculated R value (including the window) is 4.76 (see FIG. 6). Even when used with floor length draperies, the liner extends only over the frame of the window which saves considerably on the cost of the liner fabric.

While in accordance with the Patent Statutes the preferred form of the invention has been illustrated and described, it will be apparent to those skilled in the art that various changes and modifications may be made without deviating from the inventive concepts set forth above.

What is claimed is:

1. A drapery assembly for covering a framed wall opening, comprising (a) a horizontal traverse rod assembly adapted for mounting adjacent the horizontal upper portion of the opening frame, said traverse rod assembly including a pair of master slides, and means for displacing said master slides between adjacent and separated positions relative to each other, respectively;

(b) a horizontal track member adapted for connection with the upper horizontal portion of the opening frame and extending the length thereof;

(c) a pair of vertically arranged center support members connected at their upper ends for sliding movement longitudinally of said track members, said supports being displaceable between closed positions adjacent the center portion of said track member, and open positions adjacent the ends of said track member, respectively;

(d) a pair of coplanar liner panels extending parallel with and adjacent said horizontal track member, the adjacent side edges of said liner panels being connected with said center support members, respectively, and the remote side edges of said panels being connected with the side portions of the opening frame, respectively;

(e) means connecting said center support members with said master slides, respectively; and (f) releasable means locking together said center support members when in the closed position, whereby when said releasable means are in the released condition and when drapery panels are mounted on said traverse rod, movement of said master slides to effect opening and closing of the drapery panels effects simultaneous opening and closing of said liner panels.

2. The drapery assembly as recited in claim 1, wherein said liner panels comprise at least three layers of material quilted in vertical parallel rows, and further wherein at least one of said layers comprises a material having insulating properties and another of said layers comprises a radiation-reflecting material.

3. The drapery assembly as recited in claim 1, wherein said pair of center support members comprises a continuous rigid interlocking support for joining and sealing said liner panels when closed over said opening, and further wherein said support members are adapted to fit within the vertical confines of the opening frame.

4. The drapery assembly as recited in claim 3, wherein the top and bottom edges of said liner panels extend at least partially over the top and bottom portions of the opening frame, respectively, and further wherein means are provided to effect a touching seal between said liner panels and the opening frame.

5. The drapery assembly as recited in claim 4, and further including additional bottom closure means for sealing the bottom edges of said liner panels to the opening frame when said panels are in the closed position.

6. The drapery assembly as recited in claim 1, wherein said means connecting said center support members with said master slides comprises a pair of bracket members, one end of each said member being pivotally arranged at the top of each said center support member, the other end of each said member being secured to one of said master slides.

* * * * *